US007741006B2

(12) United States Patent
Yang et al.

(10) Patent No.: US 7,741,006 B2
(45) Date of Patent: Jun. 22, 2010

(54) LASER PATTERNING METHOD FOR FABRICATING DISC STAMPER

(75) Inventors: Chin-Tien Yang, Taipei County (TW); Ming-Fang Hsu, Taipei (TW); Sheng-Li Chang, Hsinchu County (TW); Tzuan-Ren Jeng, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 497 days.

(21) Appl. No.: 11/743,678

(22) Filed: May 3, 2007

(65) Prior Publication Data

US 2008/0185291 A1 Aug. 7, 2008

(30) Foreign Application Priority Data

Feb. 2, 2007 (TW) ..... 96103858 A

(51) Int. Cl.
*G03F 7/00* (2006.01)
*G03F 7/004* (2006.01)
*G03F 7/40* (2006.01)

(52) U.S. Cl. ..... 430/270.1; 430/950; 430/290; 430/292; 430/306; 430/322; 430/945; 430/947

(58) Field of Classification Search ..... 430/270.1, 430/8, 290, 292, 306, 322, 945, 947, 950
See application file for complete search history.

(56) References Cited

U.S. PATENT DOCUMENTS 4,651,172 A * 3/1987 Watanabe et al. ..... 346/135.1
5,510,141 A * 4/1996 Makita et al. ..... 427/165
5,630,872 A * 5/1997 Ogi et al. ..... 106/287.18
7,029,831 B2 * 4/2006 Minami et al. ..... 430/321
2004/0170916 A1 9/2004 Kouchiyama et al.
2005/0130335 A1 * 6/2005 Ito et al. ..... 438/22

FOREIGN PATENT DOCUMENTS

JP 2006172637 A * 6/2006
TW 00464856 11/2001

OTHER PUBLICATIONS

Akira Kouchiyama et. al, "High-Resolution Blue-Laser Matering Using an Inorganic Photoresist", Jpn. J. Appl. Phys. vol. 42(2003) pp. 769-771 Part 1. No. 2B, Feb. 2003, The Japan Society of Applied Physics.

M. S. M. Saifullah, et al., "Sub-10 nm Electron Beam Nanolithography Using Spin-Coatable TiO2 Resists", Nano Letters 2003 vol. 3, No. 11 p. 1587-1591.

* cited by examiner

*Primary Examiner*—Amanda C. Walke
(74) *Attorney, Agent, or Firm*—Jianq Chyun IP Office

(57) ABSTRACT

A method for fabricating a disc stamper is provided. First, a substrate is provided. Next, a layer of a coatable inorganic material is coated on the substrate, wherein the coatable inorganic material is an oxide, in which the chemical element constitution is more than one element selected from the group consisting of Te, Al, Zr, and Ti. Next, a laser beam is utilized to perform direct write on the layer of the coatable inorganic material to form a relief pattern. Thereafter, a metal layer is electroplated on the relief pattern. Next, the metal layer is separated from the relief pattern. The layer of the coatable inorganic material is utilized to form the relief pattern, so that it is more compatibility to equipment apparatus and lower cost in contrast with sputtered PTM process.

13 Claims, 6 Drawing Sheets

LASER PATTERNING METHOD FOR FABRICATING DISC STAMPER

CROSS-REFERENCE TO RELATED APPLICATION

This application claims the priority benefit of Taiwan application serial no. 96103858, filed Feb. 2, 2007. All disclosure of the Taiwan application is incorporated herein by reference.

BACKGROUND OF THE INVENTION

1. Field of the Invention

The present invention generally relates to a coatable inorganic material and a method for fabricating a disc stamper using the same.

2. Description of Related Art

Along with the development of high definition televisions (HD-TV), some high density optical discs are demanded to have a capacity of up to 25 GB on a single layer at a single surface. The capacity on a single layer at a single surface may even reach up to 100 GB in the near future, which requires the size of recording spots to be minimized to less than 100 nm. Therefore, storage technologies in sub-terabyte level or terabyte level will become an important research topic of the manufacturers in the field.

As to the disc recording process, the property of the photoresist material used therein is one of the critical factors that affect the defining ability of a disc master pattern. In a conventional deep ultraviolet light (DUV) laser beam direct write mastering process, the photoresist generally used is an organic photoresist system. For a laser beam recorder system with a DUV wavelength of 257 nm, or 266 nm, the maximum NA of an adopted objective lens is 0.9, and the minimum spot size thereof is about 150 nm in theory. The above laser beam recorder systems employ two different kinds of photo mode organic photoresists generally used at present, which are I-line photoresist and chemical amplified type photoresist (DUV CA photoresist), respectively, and the contrast ($\gamma$) of this kind of photoresist and the obtainable minimum pattern size definition capability are mostly considered in selecting the photoresist.

Taking the current research data in general, it is known that the maximum contrast of the I-line photoresist is usually 3, the contrast of the DUV chemical amplified type photoresist is 8, and the optimal pattern resolution thereof can reach the minimum pattern structure size of 130 nm to 180 nm. That is to say, the current DUV laser beam recorder systems with the mentioned organic photoresists cannot meet the requirements of nano-scale pattern definition capability ($\leqq$100 nm). Additionally, in regard to I-line photoresist, besides having a contrast not high enough, this type of photoresist also has an insufficient transparency to DUV light, such that this photoresist cannot achieve a higher resolution capability. Although the other type of chemical amplified type photoresist has a higher contrast $\gamma$ (about two times of that of the I-line photoresist), the polymer main chain of this type of photoresist is easily contaminated by environment, resulting in the limitation of the usage of this type of photoresist. Further, the I-line photoresist and the chemical amplified type photoresist are composed of a polymer with chain structure of high molecular weight. Thus, the surface roughness of the pattern after development becomes higher due to the molecular cluster property of the polymer.

As described above, for the current DUV laser of 257/266 nm and the laser beam recorder system with a high NA of 0.9, if the laser wavelength is further reduced or a near-field optical laser beam recorder system (NA>1) is developed, the mechanical precision and the control precision must be improved, and the component cost and production cost of the device will be greatly increased, thus limiting the development thereof. Therefore, in the nano-scale laser beam direct write mastering technique, it is a major issue to be solved urgently on how to overcome the optical diffraction limit of the laser beam recorder machine. The possibility of using a material process technique together with the existing laser beam recorder system as a solution can not only overcome the seemingly insuperable optical diffraction limit, but also effectively reduce the production cost of the device.

Recently, there is phase transition mastering (PTM) technology involving forming films by a sputtering process, used for fabricating a disc stamper, which process is illustrated in FIG. 1.

Referring to FIG. 1, in step 100, a substrate is provided, and then a phase change metal or oxide target material is sputtered on the substrate in the manner of sputtering film formation by a high-vacuum sputtering system (Step 102), and most of this type of inorganic resist material can complete the laser beam direct write mastering process by controlling the phase change between the crystalline and amorphous phase of the alloy thin film. The sputtering resist generally is a chalcogenide material or a metal oxide formed by sputtering, and in this figure a layer of chalcogenide material is taken as an example. Afterward, the layer of chalcogenide material is exposed by a laser (Step 104). Then, an additional specific wet etching solution is needed to reserve or remove the region generated through thermochemical reaction, i.e., to develop, so as to form a pattern (Step 106). Next, nickel is electroplated on the pattern to form a nickel layer (Step 108). Finally, the nickel layer and the pattern on the substrate are separated (Step 110).

However, the sputtering phase transition laser beam direct write mastering technique adopts a phase change metal resist film that is sputtered by a high-cost and complicated vacuum sputtering coating system, such that the device cost is much higher than that of the conventional photoresist spin coating film-formation process and the wet etching solution is special. Additionally, the reflectance of the film layer of phase change metal resist is too high, and cannot be used in a laser beam recorder with auto-focusing servo system. If the layer of phase change metal resist, utilized in the sputtered phase transition mastering (PTM), is adopted, it is needed to purchase an entirely new process device, thus resulting in a great increment in the investment of the device.

SUMMARY OF THE INVENTION

Accordingly, the present invention is directed to a method for fabricating a disc stamper having better equipment compatibility and higher competence by lower cost thereof.

The present invention provides a method for fabricating a disc stamper, which includes: providing a substrate, and coating a layer of a coatable inorganic material on the substrate. The coatable inorganic material is an oxide, in which the chemical element constitution is more than one element selected from the group consisting of tellurium (Te), aluminium (Al), zirconium (Zr), and titanium (Ti). Then, a laser beam is utilized to perform direct write on the layer of the coatable inorganic material in order to form a relief pattern. Thereafter, a metal layer is electroplated on the relief pattern. Next, the metal layer is separated from the relief pattern for creating a metal disc stamper.

The present invention adopts a coating process to form a thermal-write type coatable inorganic material on a substrate without an additional developing and etching process after a laser beam direct write, the process is simplified and the resolution of the pattern is excellent enough to reach the nano scale (≦100 nm). In addition, as the spin coating process can be adopted, the present invention has the following advantages: no high-vacuum sputtering device system is needed; the material composition is easy to control and the material can be coated on a large-sized substrate; no problem of the crystalline phase and texture of microscopic crystal occurs; and the thickness of the film layer can be controlled by simple parameters (such as rotation velocity and concentration) and is in good uniformity during the creation of the disc stamper. Additionally, compared with the conventional organic material, the coatable inorganic material of the present invention can effectively improve the pattern configuration (e.g. surface roughness) of the pattern formed by the conventional laser beam recorder, so as to further improve the electronic signals read from the disc.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
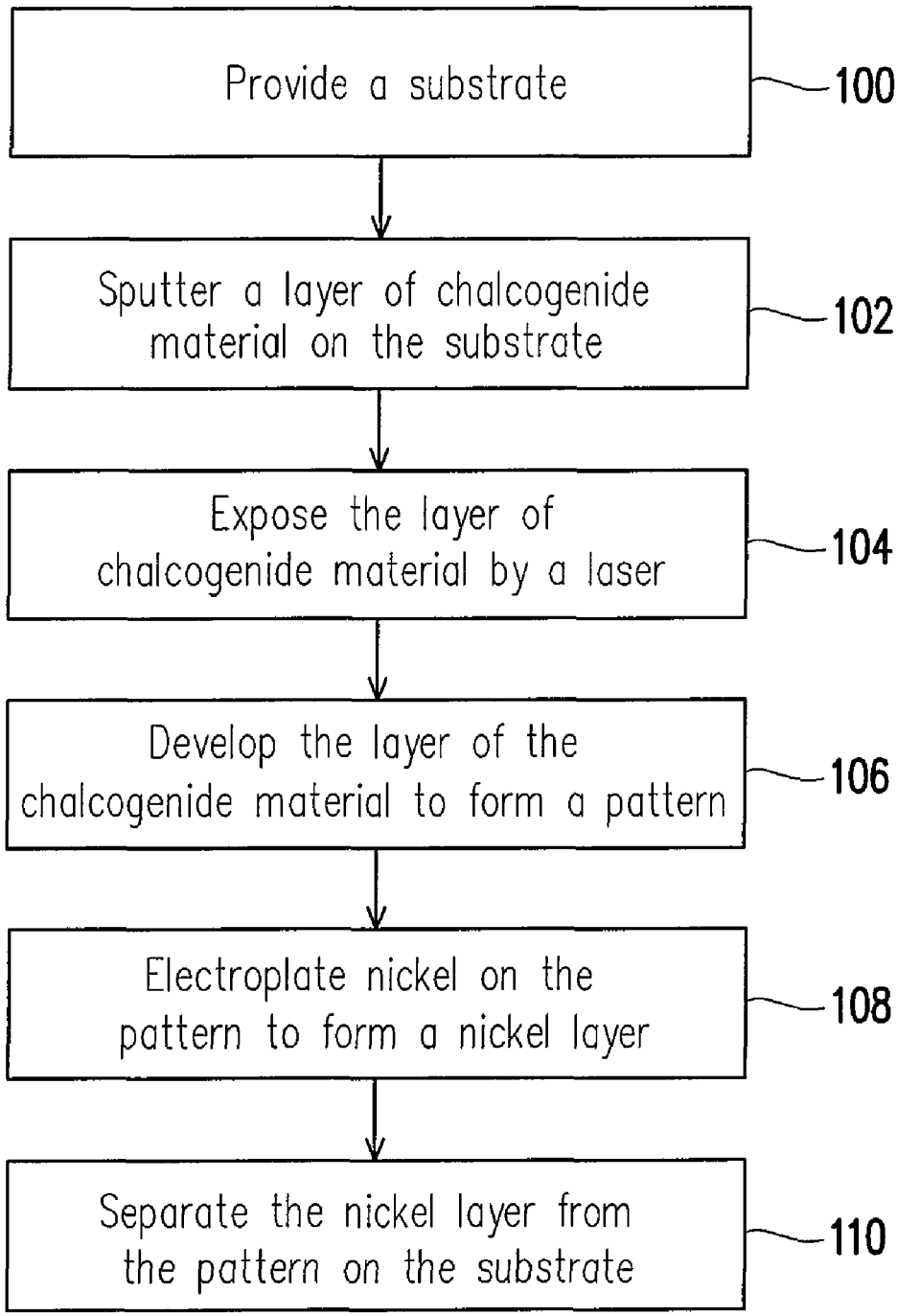
FIG. 1 (PRIOR ART)
FIG. 1 is flow chart of fabricating a disc stamper in a conventional art.

Reference will now be made in detail to the present embodiments of the invention, examples of which are illustrated in the accompanying drawings. Wherever possible, the same reference numbers are used in the drawings and the description to refer to the same or like parts.

Figure 2:
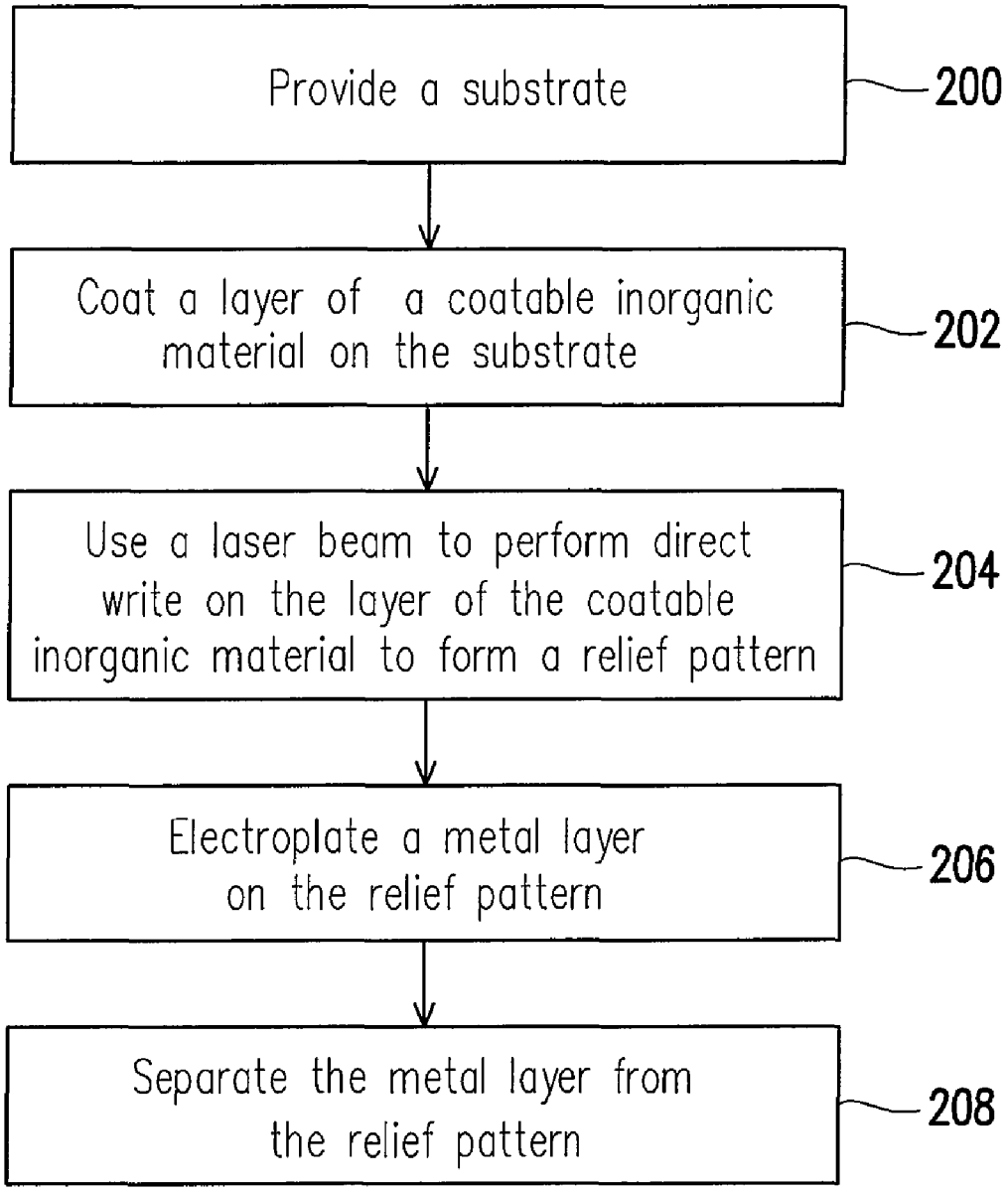
FIG. 2 is flow chart of creating a disc stamper of an embodiment according to the present invention.

FIG. 2 is flow chart of creating a disc stamper of an embodiment according to the present invention.

Referring to FIG. 2, in step 200, a substrate, for example, a silicon wafer, or quartz, plastic, glass or carbon substrate, is provided. In addition, some processing or processes can be performed on the substrate in advance, so as to form some predetermined components.

Next, in Step 202, a layer of a coatable inorganic material is coated on the substrate, and the coatable inorganic material includes an oxide, in which the chemical element constitution is more than one element selected from Te, Al, Zr, and Ti. The coatable inorganic material is, for example, a low molecular weight sol-gel solution prepared by a sol-gel process. Therefore, the coatable inorganic material further includes β-ketoesters, such as methyl acetoacetate, ethyl acetoacetate, isopropyl acetoacetate, isobutyl acetoacetate, isoamyl acetoacetate; or β-diketoesters, such as acetylacetone (AcAc) or benzoylacetone (BzAc). The synthesis method of the sol-gel solution is illustrated by taking the sol-gel solution of titanium oxide for example as follows: the β-ketoesters or β-diketoesters are mixed with tetra-n-butyl titanate ($Ti(OC_4H_9)_4$) as a precursor at the room temperature, and then reacted with alcohol for several hours, so as to form a coatable inorganic material sol-gel solution (refer to M. S. M. Saifullah, et al, "Sub-10 nm Electron Beam Nanolithography Using Spin-Coatable $TiO_2$ Resists", *Nano Lett.,* Vol. 3, No. 11, pp. 1587-1591 (2003)). Certainly, according to different materials of the desired layer of the coatable inorganic material, the precursor or the process parameters of the above sol-gel process can be adjusted or altered.

Figure 3:
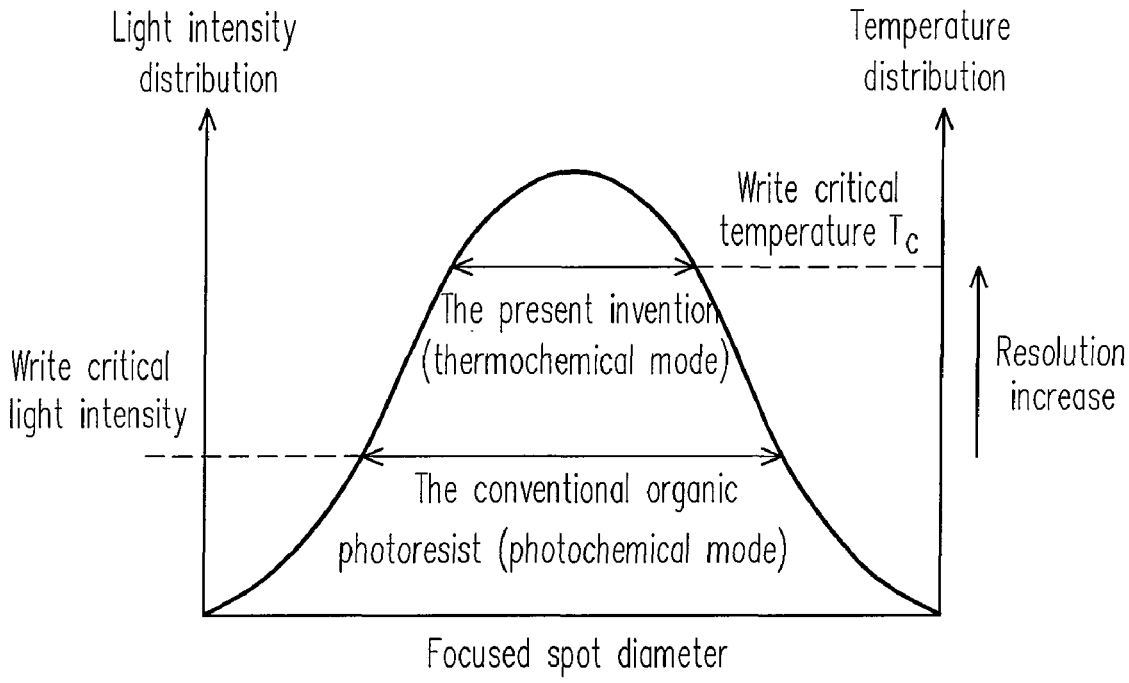
FIG. 3 is a curve diagram showing the light intensity distributions, light spot diameters, and temperature distributions of focused laser spots of the coatable inorganic material according to the embodiment of the present invention and the conventional photochemical mode organic photoresist material.
Figure 4:
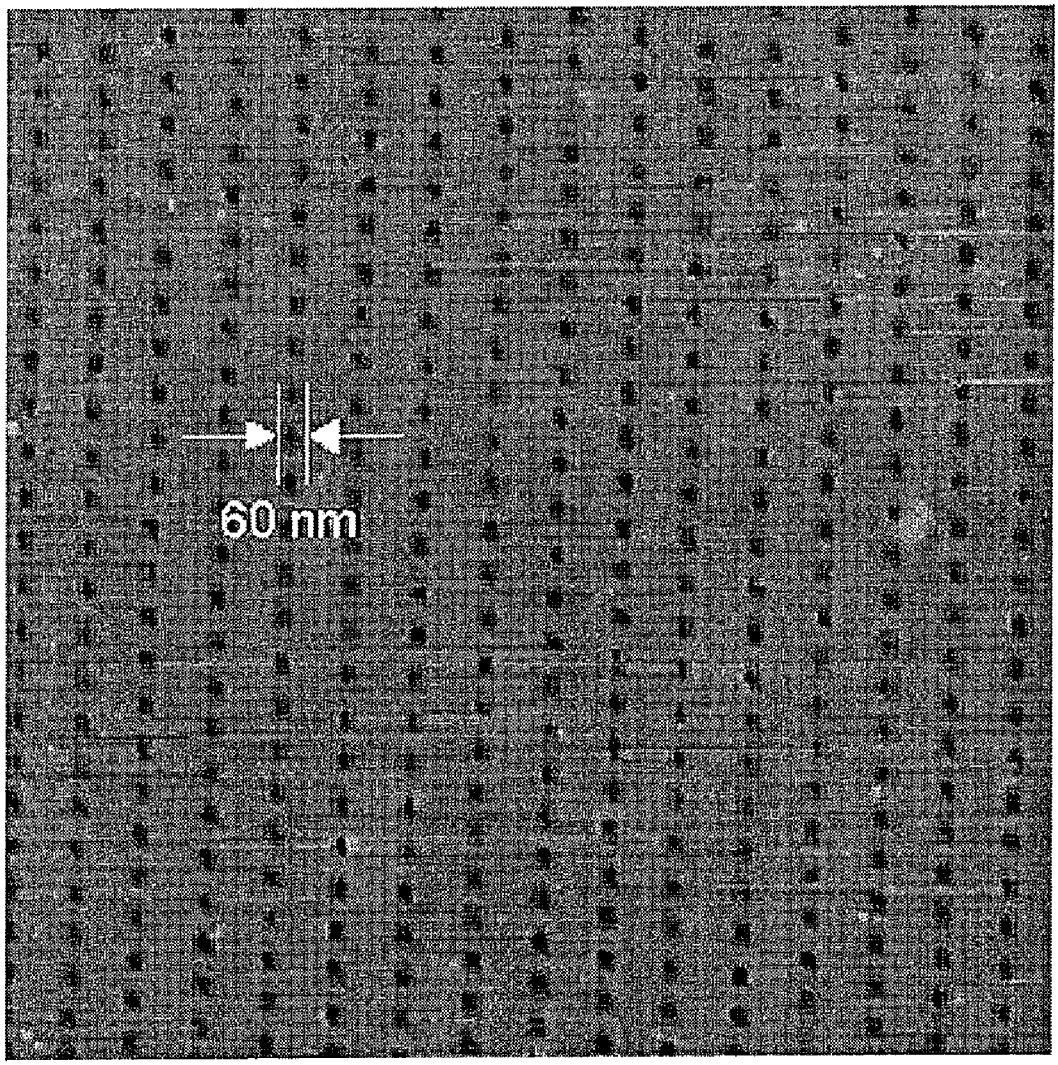
FIG. 4 is a microscopic image taken by atomic force microscopy (AFM) of pits pattern formed with the coatable inorganic material of the present invention after laser direct write.
Figure 5:
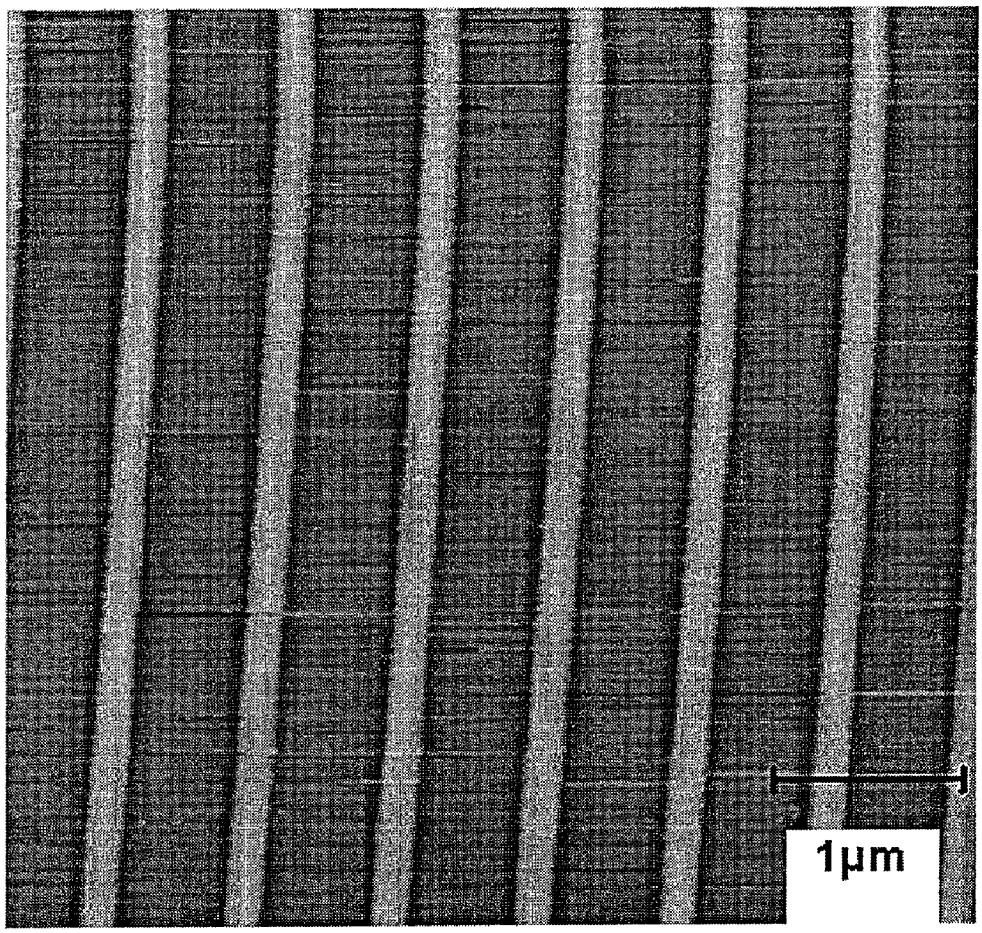
FIG. 5 is a microscopic image taken by AFM of a groove and line (or land) pattern formed with the coatable inorganic material of the present invention after laser direct write.

The coatable inorganic material of the present invention is a thermochemical mode coatable inorganic material, which can overcome the optical diffraction limit effectively, and has an improved pattern resolution capability. FIG. 3 is a curve diagram showing the light intensity distribution, spot diameter, and temperature distribution of the focused laser spot of the coatable inorganic materials according to the embodiment and the conventional photochemical mode organic photoresist material. In FIG. 3, in regard to the conventional photochemical mode organic photoresist material, the size of the recording spot (spot diameter D) is about the size of the diameter of the laser spot. While for the coatable inorganic material according to the embodiment, only the part of high temperature in the center of the laser beam performs a thermochemical reaction, so this reaction mechanism can scale down the recording spot by about one third to one fourth (spot diameter d) compared with that of the organic photoresist material. Therefore, the pattern definition capability of the coatable inorganic material of the present invention can reach the nano-scale (<100 nm), and the results are as shown in FIG. 4, in which the pit size of the pattern is about 60 nm. Additionally, FIG. 5 shows a microscopic image taken by atomic force microscopy (AFM) of a groove and line patterns formed with the coatable inorganic material after laser direct write. In contrast to the conventional pattern formed with organic photoresist, the coatable inorganic material of the present invention has a extremely lower surface roughness and line edge roughness, and consequently a pattern of a disc stamper with said lower surface roughness and line edge roughness efficiently promotes the electronic signal characteristic of the high density disc stamper.

Being a low molecular weight sol-gel solution prepared by a sol-gel process, the above-mentioned coatable inorganic material has higher transparency and lower reflectance compared with the sputtering inorganic resist, and the transparency thereof is similar to the conventional organic photoresist. The method of forming a layer of a coatable inorganic material on a substrate by coating may include a spin coating process. Additionally, as the coatable inorganic resist according to the embodiment has a good chemical adhesion to the substrate, no adhesion layer needs to be coated in-between, and thus the process of forming a pattern is simplified.

Next, in step 204, a laser beam is used to perform direct write on the layer of the coatable inorganic material, so as to form a relief pattern. In addition, for example, a relief pattern is formed, for example, laser beam recorder with auto-focusing servo system, so the process in FIG. 2 has a high compatibility with the conventional laser beam direct write lithography process. The laser beam direct write lithography machine may have a light source with a wavelength ranging from DUV to UV wave band, preferably 220 nm to 413 nm. Due to the layer of the coatable inorganic material, the formed relief pattern has a quite excellent resolution, and can be a nano-pattern, for example, a relief pattern having grooves or pits. Additionally, the variation of the aspect ratio of the relief pattern can be directly controlled by the power of the laser beam.

Next, in step 206, a metal layer is electroplated on the relief pattern. The material of the metal layer for example can be nickel, silver, platinum, palladium, or alloy thereof. Finally, in step 208, the metal layer is separated from the relief pattern. Thus, the fabrication of a metal disc stamper is completed.

Figure 6:
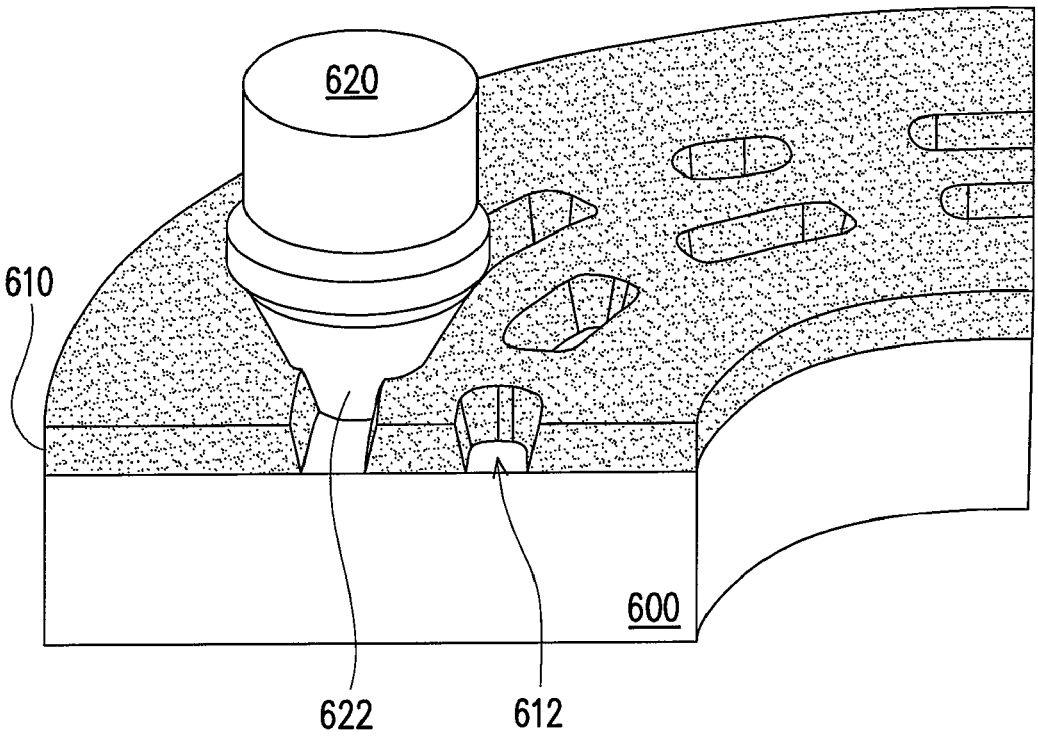
FIG. 6 is a schematic stereogram of a layer of the coatable inorganic material during laser beam direct write in step 204 of FIG. 2.

FIG. 6 is a schematic stereogram of a layer of the coatable inorganic material during laser beam direct write in step 204 of FIG. 2.

In FIG. 6, 600 represents a substrate, 610 represents a layer of a coatable inorganic material, 620 represents a lens of a laser beam recorder machine, and 622 represents a laser beam. When the laser beam 622 irradiates the layer of the coatable inorganic material 610, grooves or pits 612 are generated directly. Furthermore, after Step 204, the pattern contrast is directly formed without an additional developing and etching process, and the pattern directly formed by the light beam direct write has an improved surface roughness and line edge roughness.

In summary, the present invention has at least the following effects.

The coatable inorganic material according to the present invention has a relatively high transparency and goes through a spin coating process, thus it has higher compatibility with the process device and is more competitive with a lower cost than the sputtered phase transition mastering (PTM).

As the coatable inorganic material of the present invention goes through a spin coating process, no high-vacuum sputtering device system is needed; the material composition is easy to control and the material can be coated on a large-sized substrate; no problem of the crystalline phase and texture of microscopic crystal occurs as that in the sputtered PTM process; and the thickness of the film can be controlled by simple parameters (such as rotation velocity and concentration) and is in good uniformity.

The coatable inorganic material of the present invention is a sol-gel solution having lower molecular weight, so the problem of low molecular weight and few molecular clusters exists. Thus, the pattern formed has relative low surface roughness and line edge roughness, up to ≦1 nm.

As for the formation of a pattern according to the present invention, the coatable inorganic material is characterized in directly forming a pattern of grooves or pits in the region exposed by an energy beam on the surface through a thermochemical relief reaction after being exposed by a laser beam energy direct write, so a pattern contrast can be formed directly without an additional developing and etching process.

The coatable inorganic material of the present invention is used to form a relief pattern by a thermochemical mode, so as to effectively overcome the optical diffraction limit, improve the pattern resolution, and reduce the focused spot diameter of the laser beam to nano scale (≦100 nm).

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method for fabricating a disc stamper, comprising:

providing a substrate;

coating a layer of a coatable inorganic material on the substrate, wherein the coatable inorganic material is a coatable inorganic material sol-gel solution prepared by a sol-gel process and the coatable inorganic material comprises an oxide, in which the chemical element constitution is more than one element selected from the group consisting of Te, Al, Zr, and Ti;

utilizing a laser beam to perform direct write on the layer of the coatable inorganic material to form a relief pattern;

electroplating a metal layer on the relief pattern; and separating the metal layer from the relief pattern.

2. The method for fabricating a disc stamper according to claim 1, wherein the relief pattern is in a nano scale.

3. The method for fabricating a disc stamper according to claim 1, wherein the relief pattern comprises grooves or pits.

4. The method for fabricating a disc stamper according to claim 1, wherein the variation of the aspect ratio of the relief pattern is controlled by the power of the laser beam.

5. The method for fabricating a disc stamper according to claim 1, wherein the relief pattern is formed by a laser beam recorder.

6. The method for fabricating a disc stamper according to claim 5, wherein the laser beam recorder has a light source with a wavelength ranging from DUV to UV wave band.

7. The method for fabricating a disc stamper according to claim 1, wherein the step of coating the layer of the coatable inorganic material on the substrate comprises a spin coating process.

8. The method for fabricating a disc stamper according to claim 1, wherein the coatable inorganic material comprises low molecular weight sol-gel solution.

9. The method for fabricating a disc stamper according to claim 1, wherein the coatable inorganic material further comprises β-ketoesters or β-diketones.

10. The method for fabricating a disc stamper according to claim 1, wherein the coatable inorganic material further comprises methyl acetoacetate, ethyl acetoacetate, isopropyl acetoacetate, isobutyl acetoacetate or isoamyl acetoacetate.

11. The method for fabricating a disc stamper according to claim 1, wherein the coatable inorganic material further comprises acetylacetone (AcAc) or benzoylacetone (BzAc).

12. The method for fabricating a disc stamper according to claim 1, wherein the substrate comprises silicon wafer or quartz, plastic, glass or carbon substrate.

13. The method for fabricating a disc stamper according to claim 1, wherein a material of the metal layer comprises nickel, silver, platinum, palladium or alloy thereof.

* * * * *